US008464732B2

(12) United States Patent
Wong

(10) Patent No.: US 8,464,732 B2
(45) Date of Patent: Jun. 18, 2013

(54) FACIAL MAKE-UP APPLICATION MACHINE AND MAKE-UP APPLICATION METHOD USING THE SAME

(75) Inventor: Charlene Hsueh-Ling Wong, Taipei (TW)

(73) Assignee: Zong Jing Investment, Inc., Taipei (TW)

( * ) Notice: Subject to any disclaimer, the term of this patent is extended or adjusted under 35 U.S.C. 154(b) by 19 days.

(21) Appl. No.: 13/137,799

(22) Filed: Sep. 14, 2011

(65) Prior Publication Data

US 2012/0067364 A1 Mar. 22, 2012

(30) Foreign Application Priority Data

Sep. 21, 2010 (TW) ..... 99131981 A

(51) Int. Cl.

| | |
|---|---|
| ***A45D 40/24*** | (2006.01) |
| ***A45D 7/00*** | (2006.01) |
| ***A45D 44/00*** | (2006.01) |
| ***A45D 40/30*** | (2006.01) |
| ***G09B 25/00*** | (2006.01) |
| ***G06K 9/00*** | (2006.01) |

(52) U.S. Cl.

USPC ..... 132/317; 132/200; 132/319; 132/333; 434/377; 382/118

(58) Field of Classification Search

USPC ..... 132/200, 333, 212, 73, 317–320, 132/286, 294, 314; 434/377, 99, 100; 345/582, 345/629; 601/17, 18; 700/264, 245, 161, 700/90, 213, 302, 231, 233; 702/1, 127, 155, 702/167, 168; 382/115, 117, 118, 153, 154, 382/199, 266; 901/41, 43, 46, 47, 14; 222/144; 705/27.2

See application file for complete search history.

(56) References Cited

U.S. PATENT DOCUMENTS

| | | | | |
|---|---|---|---|---|
| 3,570,500 | A * | 3/1971 | Berry | 132/213 |
| 4,128,317 | A * | 12/1978 | LeCover | 351/245 |
| 4,434,467 | A * | 2/1984 | Scott | 700/90 |
| 5,125,731 | A * | 6/1992 | Fiorini et al. | 351/245 |
| 5,785,960 | A * | 7/1998 | Rigg et al. | 424/63 |
| 6,035,860 | A * | 3/2000 | Mombourquette | 132/200 |
| 6,286,517 | B1 * | 9/2001 | Weber et al. | 132/73 |
| 6,502,583 | B1 * | 1/2003 | Utsugi | 132/200 |
| 6,622,064 | B2 * | 9/2003 | Bartholomew et al. | 700/233 |

(Continued)

FOREIGN PATENT DOCUMENTS

| | | | |
|---|---|---|---|
| DE | 202004003148 | | 3/2005 |
| JP | 2008017936 | | 1/2008 |
| JP | 2008017936 | A * | 1/2008 |

*Primary Examiner* — Vanitha Elgart

(74) *Attorney, Agent, or Firm* — Bacon & Thomas, PLLC

(57) ABSTRACT

A facial make-up application machine is provided, which includes a base, a robot, a cosmetics provider, and a control device. The control device can control the robot to move the cosmetics provider to a make-up application position in order to spray or apply cosmetic materials to a contour corresponding to a human face. Thus, the invention can provide an automatic make-up application for variously and accurately carrying out the makeup-application on faces selected or emulated by one or more users. A specific facial image in the invention can be built-in or provided by an external storage device or image recognition device. The storage device can pre-store a plurality of makeup-application profiles as an option. A facial make-up application method using the same is also provided.

15 Claims, 14 Drawing Sheets

U.S. PATENT DOCUMENTS

| | | | | |
|---|---|---|---|---|
| 6,763,283 | B1 * | 7/2004 | Murakami | 700/259 |
| 6,842,172 | B2 * | 1/2005 | Kobayashi | 345/419 |
| 7,123,753 | B2 * | 10/2006 | Takahashi et al. | 382/117 |
| 7,329,003 | B2 * | 2/2008 | Nicolini | 351/244 |
| 7,634,103 | B2 * | 12/2009 | Rubinstenn et al. | 382/100 |
| 7,648,364 | B2 * | 1/2010 | Dauga et al. | 434/100 |
| D612,942 | S * | 3/2010 | Verdon-Roe | D24/172 |
| 2001/0047309 | A1 * | 11/2001 | Bartholomew et al. | 705/26 |
| 2002/0155069 | A1 | 10/2002 | Pruche et al. | |
| 2004/0078278 | A1 * | 4/2004 | Dauga et al. | 705/26 |
| 2004/0110113 | A1 * | 6/2004 | Huang et al. | 434/100 |
| 2004/0143359 | A1 * | 7/2004 | Yogo et al. | 700/161 |
| 2005/0135675 | A1 | 6/2005 | Chen et al. | |
| 2006/0132506 | A1 * | 6/2006 | Utsugi | 345/646 |
| 2009/0114236 | A1 * | 5/2009 | Mehta | 132/200 |
| 2010/0142755 | A1 * | 6/2010 | Brandewie et al. | 382/100 |
| 2010/0220933 | A1 * | 9/2010 | Takano et al. | 382/224 |
| 2010/0226531 | A1 * | 9/2010 | Goto | 382/103 |
| 2010/0243514 | A1 * | 9/2010 | Samain et al. | 206/581 |
| 2012/0027269 | A1 * | 2/2012 | Fidaleo et al. | 382/118 |
| 2012/0158184 | A1 * | 6/2012 | Ma et al. | 700/264 |

* cited by examiner

FACIAL MAKE-UP APPLICATION MACHINE AND MAKE-UP APPLICATION METHOD USING THE SAME

CROSS REFERENCE TO RELATED APPLICATION

This application claims the benefits of the Taiwan Patent Application Serial Number 99131981, filed on Sep. 21, 2010, the subject matter of which is incorporated herein by reference.

BACKGROUND OF THE INVENTION

1. Field of the Invention

The present invention relates to a facial make-up application machine and a make-up application method using the same and, more particularly, to a facial make-up application machine with an input control of automatically applying cosmetics to a human face and a facial make-up application method using the same.

2. Description of Related Art

People have a nature of enjoying pretty things. Accordingly, many large companies have developed various care and make-up products for consumers to purchase. However, repeated practice is required in order to improve make-up skills and have makeup-applied faces that are satisfactory and suited to the consumers themselves. In addition, various cosmetics and tools are purchased for different blackened eyebrows, eye shadows, eyelashes, eye liners, facial make-up, lip make-up, facial sculpting, and color changes. In this case, with different make-up capabilities and applied products, the make-up effects between the actual and desired appearances are different for each consumer.

As various information technologies have been developed, typical color simulation devices are designed for a trial of make-up or care products on screen before a user buys and applies the products, thereby replacing the in-situ application of the products. For example, in US 2005/0135675 A1, a simulation method for a makeup trial and the device thereof are disclosed. Deep image sensors are utilized to establish a three-dimensional (3D) image according to a target image and a profile signal of a user, such as the lips, eyes, or the entire face. Then, makeup data for makeup products are provided such that the user can select a corresponding makeup product using a touch panel for emulating a color makeup of the target image and displaying a makeup post-application image on a display module. Such a way requires manual skills for applying facial make-up, and hence the actual make-up may not have the same effect as the simulated one displayed on screen.

Therefore, it is desirable to provide an improved method and device to mitigate and/or obviate the aforementioned problems conventionally in the manual makeup application method and in the color simulation device for a trial of make-up.

SUMMARY OF THE INVENTION

The present invention provides a facial make-up application machine including a base, a robot, a cosmetics provider, and a control device. The base is installed with a face-positioning module. The robot is installed on the base for a three-dimensional (3D) movement and has a moving block. The cosmetics provider internally stores cosmetic materials and is installed on the moving block of the robot and is provided with an outlet for correspondingly outputting cosmetic materials. The control device is installed on the base and electrically connected to the robot and the cosmetics provider and has an input interface and a control interface. The input interface can receive specific facial images and makeup-application profiles. The specific facial images include facial contours, and the makeup-application profiles indicate the expected color makeup results after the cosmetics are applied to the facial contours. The control device uses the control interface to drive the robot in order to move the cosmetics provider to a make-up application position corresponding to the facial contour, and further instructs the cosmetics provider to output the cosmetic materials through the outlet according to a makeup-application profile. Thus, the makeup-application machine of the present invention can automatically and accurately provide various make-up applications selected or emulated by one or more users.

The specific facial images can be two-dimensional (2D) or three-dimensional (3D) specific facial images. The specific facial images can be provided by an image recognition device. The image recognition device includes an image capturing module to record the specific facial images, and is electrically connected to the control device. The control device has a two-dimensional (2D) or three-dimensional (3D) recognition software to recognize the facial contours in the shot image. The image capturing module can be a charge coupled device (CCD), a complementary metal oxide semiconductor (CMOS) device, or an equivalent device, but those are preferably cooperated with a color video camera so as to automatize make-up application. The image capturing module of the image recognition device can feed back a signal to the control device in order to adjust the make-up application position.

In addition, the specific facial images, and the makeup-application profiles can be provided by an inner storage device configured in the machine or by an external storage device. The storage device is electrically connected to the input interface of the control device, which can be a hard disk drive, compact disk drive, SD reader, MMS reader, or a built-in flash memory. The abovementioned specific facial images can be pre-taken and pre-stored in the storage device, or stored in a network drive for an internet download. The control device further includes a makeup-application simulation unit to edit the facial contour of the specific facial image into a makeup-application profile. The makeup-application profile can be obtained from a variety of makeup-application profiles edited by the makeup-application simulation unit and stored in the storage device. Alternately, the satisfactory makeup-application profiles established in advance can be stored in the storage device or the network drive mentioned above. Therefore, a variety of make-up databases can be constructed for users' selection. The makeup-application simulation unit can edit the makeup-application profiles by combining the collected make-up templates of other users and the specific facial images of the user, or by collecting Chinese or Western opera masks. Therefore, in addition to a typical facial make-up, the facial make-up application machine of the present invention can be used to make facial masks in an opera performance, and find further uses in the cultural and creative (i.e., theater & drama) industry.

In the invention, the control device further includes a distance-measuring device to help the control device to drive and control the movement of the robot. The distance-measuring device can be a laser ranger, a microwave radar, or other equivalent distance-measuring devices. The distance-measuring device outputs a distance-measuring light onto the face of a user and receives a reflective light from the face of the user. The distance-measuring device can provide the information of determining whether the correct movement of the robot is in accordance with the subject make-up application position. In addition, when the specific facial images and the makeup-application profiles are 2D images, the distance-measuring device can provide a directional position signal and a position alignment signal of one axis in planar measurement in order to provide a position and alignment data of the other dimension in space, thereby changing the 2D image into a 3D image.

In the invention, the control interface can include a display and a human-machine interface. The display can be a touch panel or a commonly non-touch display for displaying the human-machine interface thereon. The control device can control and drive the robot and the cosmetics provider to automatically apply facial make-up via operation of the display and the human-machine interface, such as a program or an instruction input to the control device. The human-machine interface can be a conventional mechanical switch, key, or knob, or an equivalent. The input interface of the control device can be electrically connected to an external electronic device in order to receive a control signal from the electronic device for driving and controlling the robot and the cosmetics provider. The external electronic device can be a notebook, a PC, a tablet PC, a netbook, a mobile phone, a personal digital assistant (PDA), and/or an equivalent. A user can see the makeup-applied faces from the display in a preview mode so as to decide the suitable or desired make-up and further control the control device for an automatic make-up application.

The facial make-up application machine can further include a security sensor electrically connected to the control device in order to detect whether the face is out of an available make-up range. When an abnormal state is detected, the security sensor can correspondingly output an abnormal signal to the control device to interrupt the operation or immediately cut off the power. The security sensor can be a pressure sensor, an optical isolator, a limit switch, or an equivalent. Accordingly, a user can prevent the cosmetic materials from being applied to the eyes or unwanted positions of the face.

In the invention, the face-positioning module of the base includes a jaw support, a head-positioning element (such as full-head, half-head), two-lateral cheek supports, a half-head-positioning element, an equivalent face-positioning module, or a combination thereof. In addition, the face-positioning module further includes a positioning mark, such as projecting at the center point of two eyebrows or pointing at a positioning mark on a mirror or screen installed in front of the face-positioning module. The positioning mark can be installed at the nose tip or the center of two eye pupils, such that users can move their faces to the face-positioning module and use the mirror or screen to see the nose tip or the center of the eye pupils to thereby adjust the position of the face to the positioning mark. Thus, the self-adjustment of the face position is made.

In the invention, the robot includes an elevator, a horizontal rail, and sliding platform. A moving block is installed on the sliding platform in order to move forward and back. The sliding platform is movably installed on the horizontal rail in order to move left and right. The horizontal rail is installed across the elevator in order to move up and down. The robot can be a typical robot used by an auto-machine or an equivalent.

The cosmetics provider includes a rotor, and the perimeter of the rotor is equipped with one or more outlets containing various cosmetic materials. A number of outlets are selected from different nozzles, extruding outlets, or brushes, or combinations thereof. The nozzles can be an inkjet nozzle, a piezoelectric nozzle, a jet nozzle, or an equivalent capable of jetting the cosmetic materials. The brushes can be, for example, an eyeliner, an eye shadow brush, an eyebrow brush, a lip pencil, a cheek brush, or an equivalent required for applying eye liner, eye shadow, lip make-up, cheek make-up, or other make-up for other areas of the face. The nozzle of the outlet can jet a single color material or three primary color materials, red (R), green (G), blue (B) to be mixed into various colors or produce a gradient color effect. Thus, the color richness of the cosmetic materials is increased.

The invention also provides a make-up method with the abovementioned facial make-up application machine, including:

(A) powering on the facial make-up application machine including a control device electrically connected to a robot and a cosmetics provider, wherein the robot has a 3D movement capability, and the cosmetics provider is installed on the robot to move therewith and internally stores one or more cosmetic materials;

(B) the control device extracting a makeup-application profile which indicates an expected color makeup corresponding to a facial contour;

(C) the control device receiving a start signal; and (D) the control device driving the robot to move the cosmetics provider to a make-up application position corresponding to the facial contour and driving the cosmetics provider to output the one or more cosmetic materials according to the makeup-application profile.

Accordingly, since the makeup-application profile is preset, resetting or parameter adjustment is not required, and the operation is very convenient to users.

In the invention, the makeup-application profile in step B is obtained from a specific facial image extracted and edited by the control device. The specific facial image contains the facial contour and is provided by an image capturing module electrically connected to the control device. The specific facial image or the makeup-application profile is alternately provided by a storage device electrically connected to the control device, which saves the need of preparing the specific facial image in advance.

In the invention, the image recognition device in step D can output a feedback signal to the control device in order to align the make-up application position. The control device includes a distance-measuring device to send a feedback signal to the control device in order to help the control device drive the robot to move to the make-up application position for allowing the cosmetics provider on the robot to accurately aim at the make-up application position. Thus, a makeup face selected or emulated by a user is embodied. Further, when the specific facial image and the make-up application profile are 2D images, the distance-measuring device can provide a function similar to that provided by a deep ranger in order to provide another dimensional data in space to further transform the 2D images into 3D images.

The cosmetic materials can be a powder, foam, gel, liquid, or solid cosmetic material, or combinations thereof. For example, a foundation, a concealer, an eyebrow, a cheek, a lip, a corrector, and a basic care material, and the various combinations thereof can be used.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
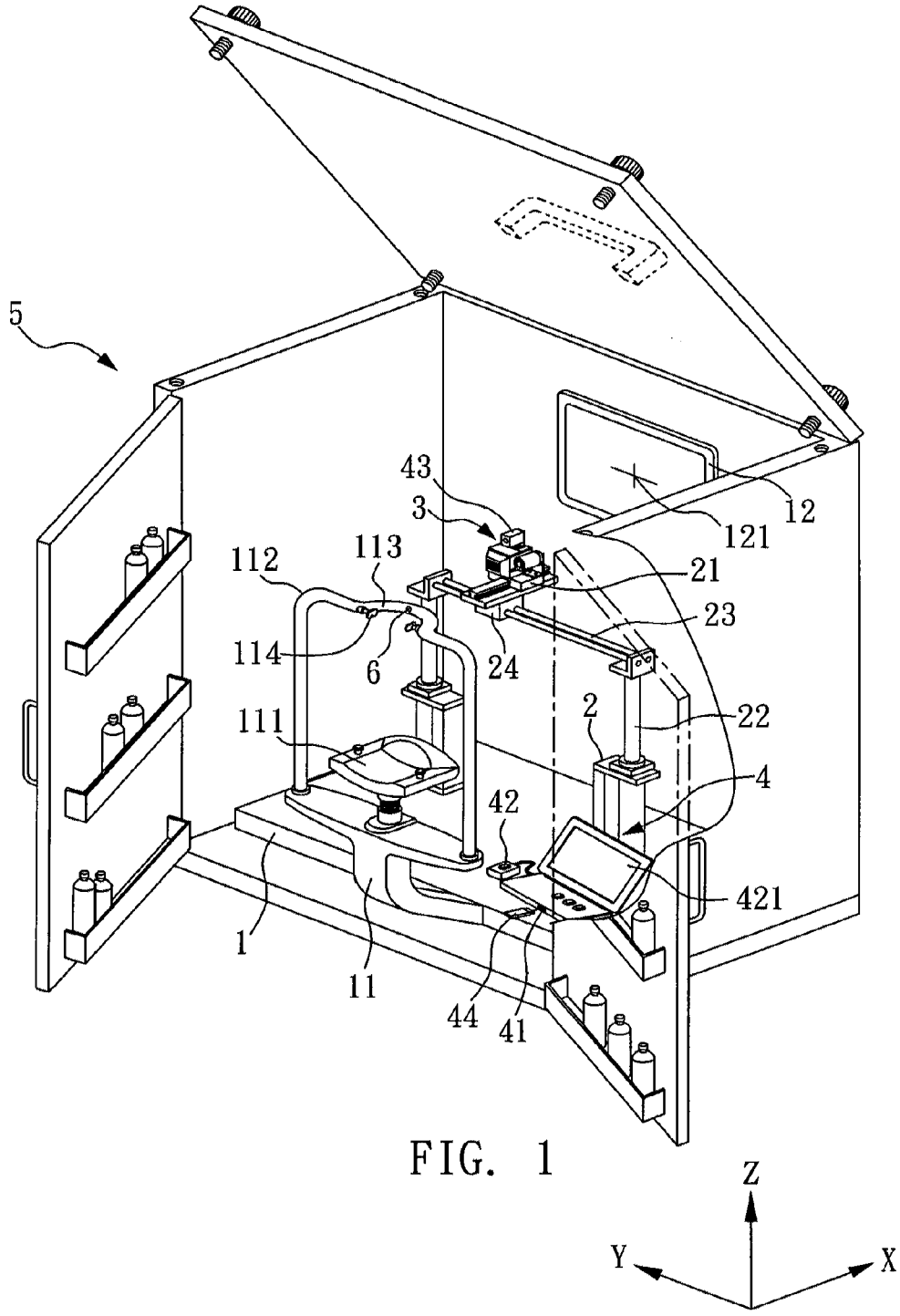
FIG. 1 is a perspective view of a facial make-up application machine according to a first preferred embodiment of the invention.
Figure 2:
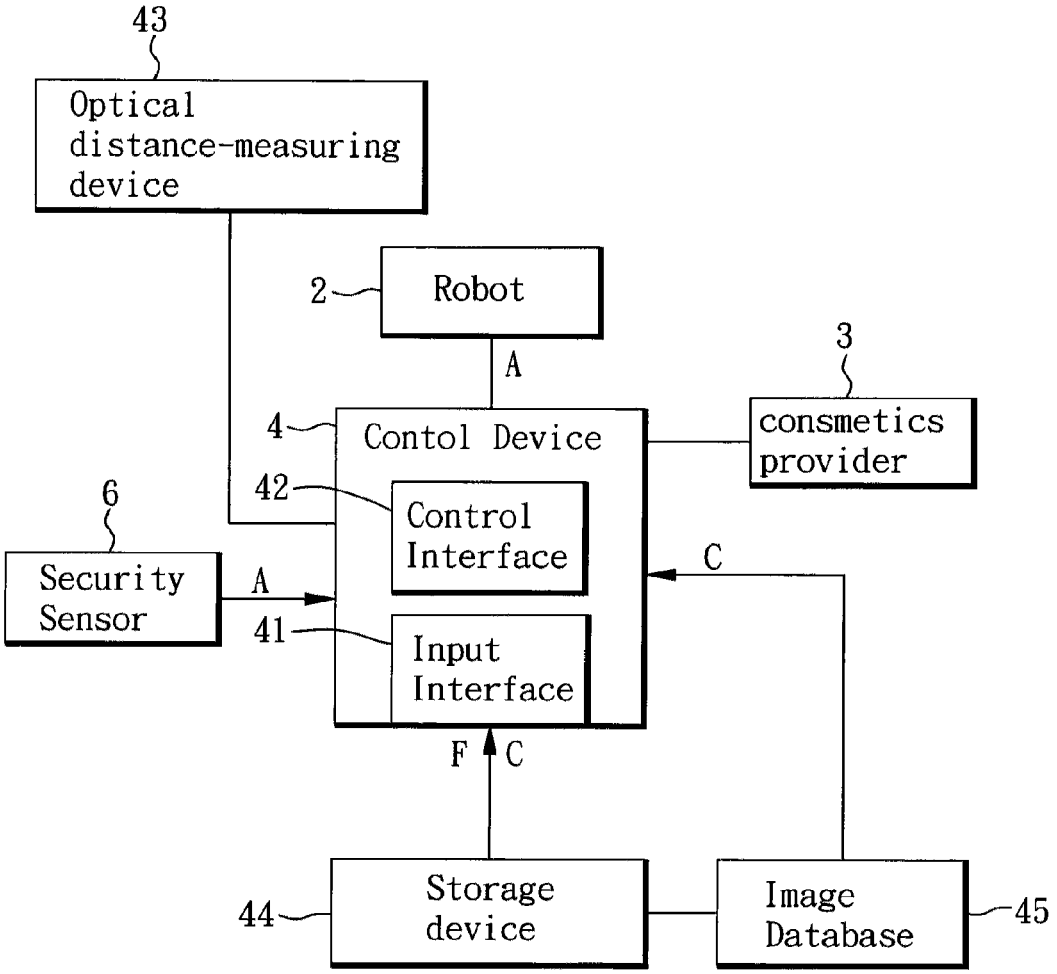
FIG. 2 is a block diagram of a facial make-up application machine according to a first preferred embodiment of the invention.
Figure 3:
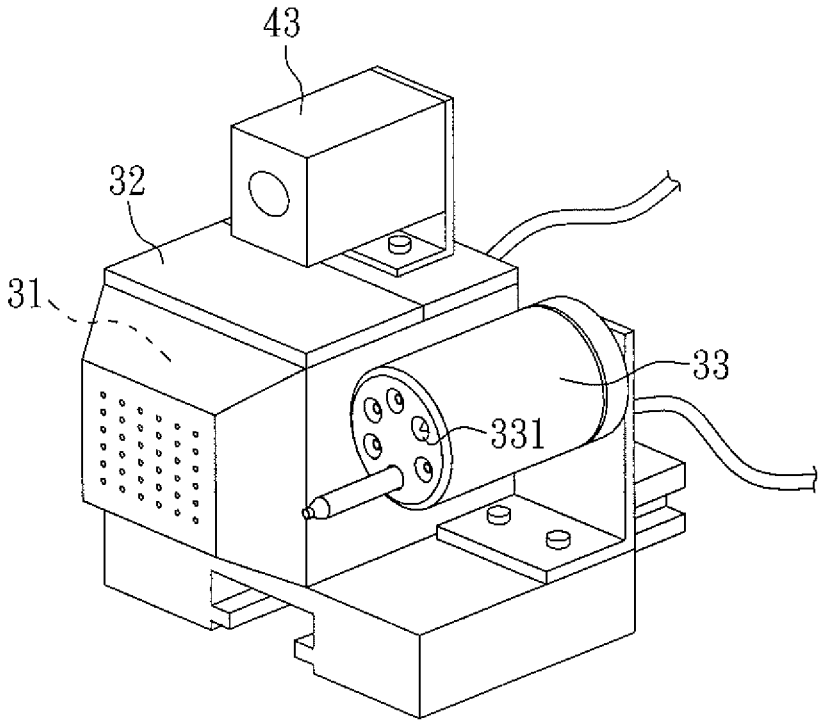
FIG. 3 is a partially enlarged view of a facial make-up application machine according to a first preferred embodiment of the invention.
Figure 9:
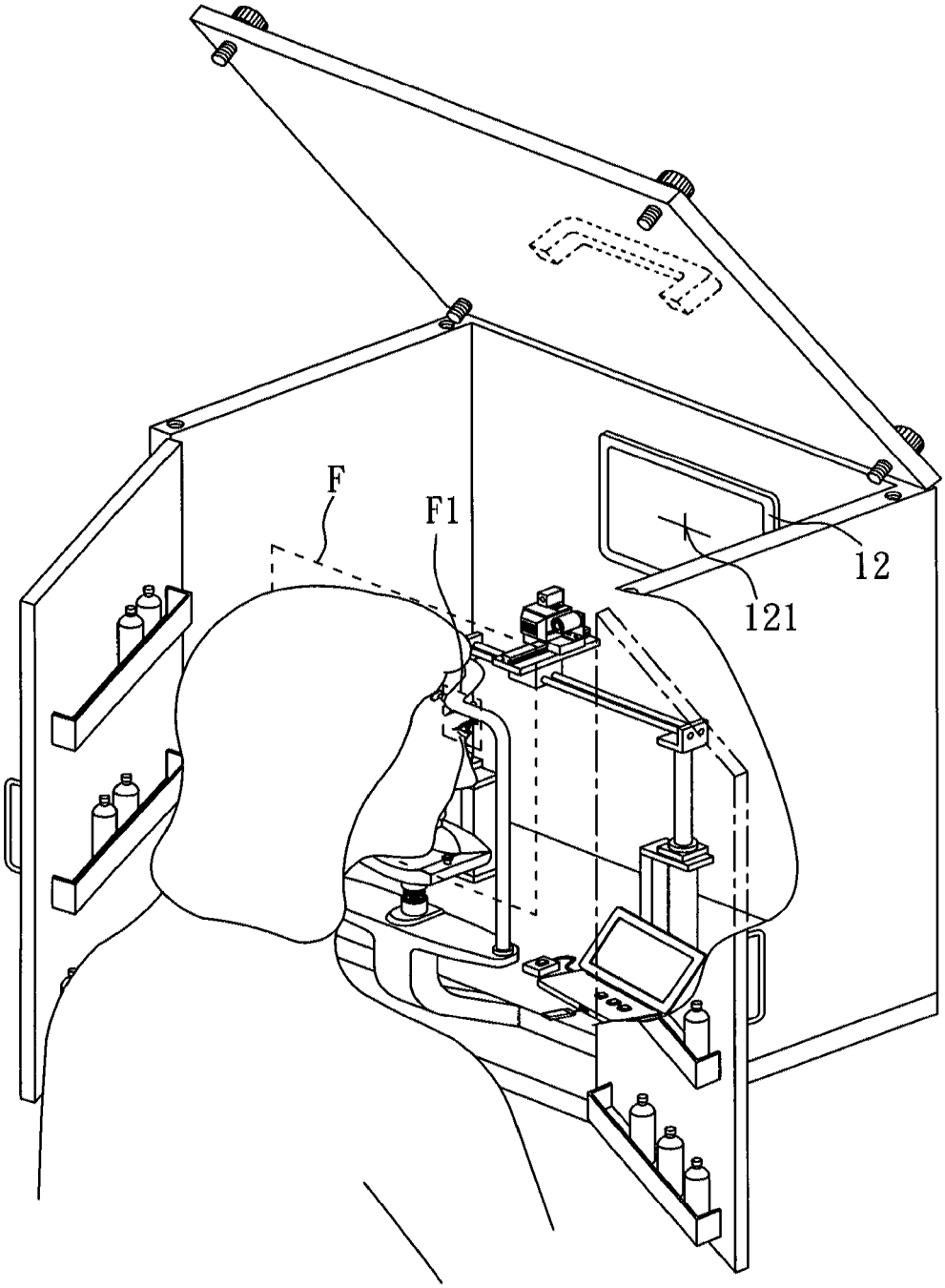
FIG. 9 is a schematic view of a specific facial image F and a facial contour F1 in space according to a first preferred embodiment of the invention.
Figure 10:
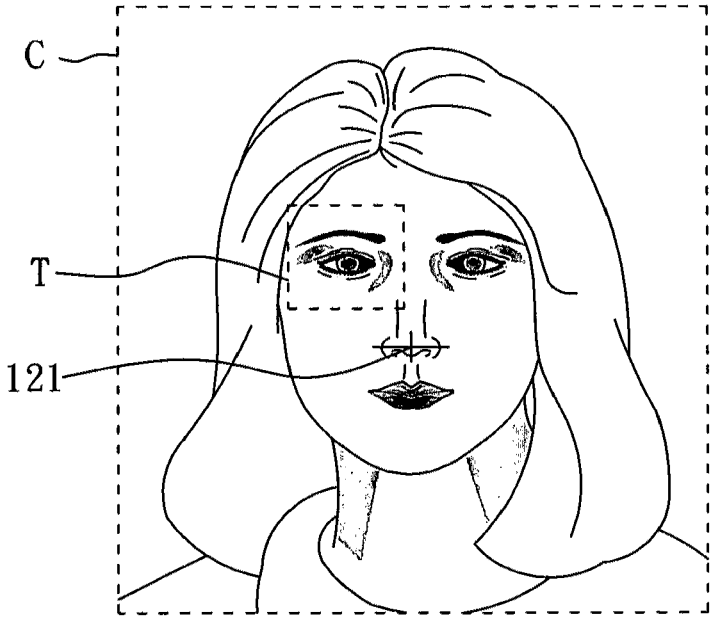
FIG. 10 is a schematic view of a makeup-application profile C and a make-up application position T according to a first preferred embodiment of the invention.

FIG. 1 is a solid view of a facial make-up application machine a first preferred embodiment of the invention. FIG. 2 is a block diagram of FIG. 1. FIG. 3 is an enlarged view of FIG. 1. FIG. 9 is a schematic view of a specific facial image and a facial contour in space according to a first preferred embodiment of the invention. FIG. 10 is a schematic view of a makeup-application profile and a make-up application position according to a first preferred embodiment of the invention. As shown in FIGS. 1-3, and 9-10, the machine of the present example includes the following:

A face-positioning module 11 is installed with a base 1 and located in front of the base 1. The face-positioning module 11 includes a jaw support 111 to support a face, and a head-positioning element 112 installed over the jaw support 111 and shaped in a slightly inverse U. The head-positioning element 112 has an arc support section 113 at the upper middle part in order to fit the forehead. Two sides of the arc support section 113 are each installed with a head fixator 114. The head fixator 114 can automatically slide in the head-positioning element by, for example, applying a known technique for connecting and controlling an oil cylinder, and the sliding distance is automatically adjusted by the head-supported force. During operation of the machine, a user can put the forehead on the support section 113 of the head-positioning element 112 and the jaw on the jaw support 111, and meanwhile the fixators 114 at two sides of the support section 113 automatically support the head at two laterals by an appropriate support force to thereby fasten two laterals of the forehead.

Figure 15:
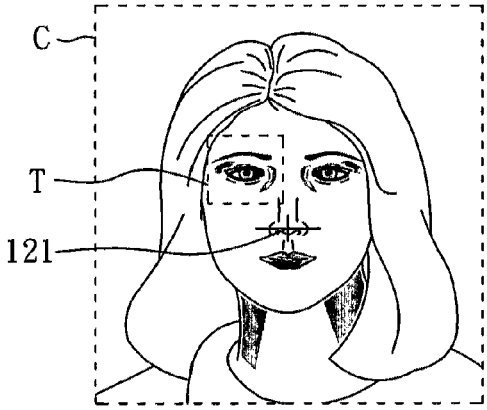
FIG. 15 is a schematic view of a makeup-application profile C and a make-up application position T according to a second preferred embodiment of the invention.

The base 1 is further installed with a mirror 12 in front of the face-positioning module 11, and the face-positioning module 11 has a positioning mark 121 aimed at the mirror corresponding to the nose tip of a user so as to allow the user to see the nose tip from the mirror 12 in front of the face and to position the face according to the positioning mark 121, as shown in FIGS. 10 and 15, for example. Thus, the self-adjustment of the face position is provided. The positioning mark 121 can be alternately set to other easily recognized positions, such as the center of two eye pupils or eyebrows.

The base 1 includes a robot 2 driven by a motor controlled by a control device 4. The robot 2 includes a moving block 21, an elevator 22, a horizontal rail 23, and a sliding platform 24. The moving block 21 is installed on the sliding platform 24 and moves forward and back along the X axis in FIG. 1. The sliding platform 24 is movably installed with the horizontal rail 23 and moves left and right along the Y axis. The horizontal rail 23 is installed across the elevator 22 and moves up and down along the Z axis. Accordingly, the robot can move in a 3D space to accurately position the moving block 21 driven by the motor controlled by the control device 4.

The cosmetics provider 3 is controlled by the control device 4 to output the materials and perform a makeup-application operation. The cosmetics provider 3 internally has one or more cosmetics containers to store various cosmetic materials 31, such as eye shadow materials. The cosmetics provider 3 is installed on the moving block 21 of the robot 2, and the cosmetics containers contain the eye shadow materials and can be a piezoelectric nozzle 32. The cosmetics containers can have different sprinklers, jet nozzles, or cosmetic tools. The cosmetics provider 3 has a rotor 33, and the cosmetics containers have various outlets 331 installed in the perimeter of the rotor 33 for outputting the cosmetic materials 31. Various cosmetic materials 31 are changeably output from a same location by rotating the rotor 33. Therefore, such a way automatically provides cosmetic tools for conveniently applying various color materials or pigments.

Figure 4:
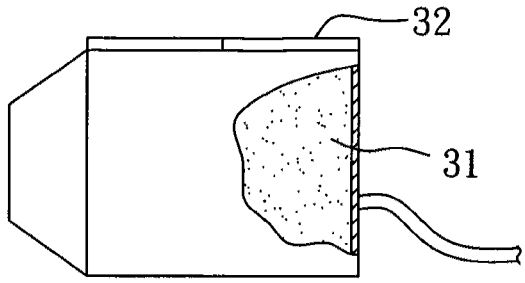
FIG. 4 is a side view of a cosmetics provider which is a piezoelectric nozzle according to a first preferred embodiment of the invention.
Figure 5:
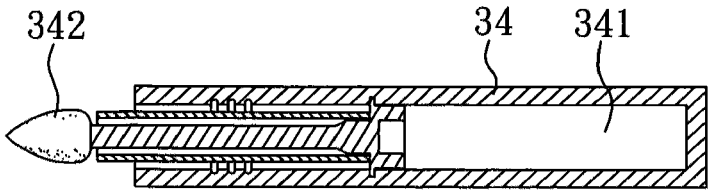
FIG. 5 is a side view of a cosmetics provider which is a brush according to a first preferred embodiment of the invention.
Figure 6:
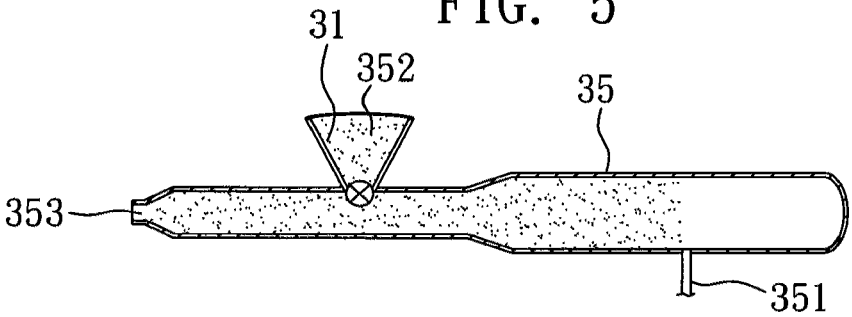
FIG. 6 is a side view of a cosmetics provider which is a jet nozzle according to a first preferred embodiment of the invention.
Figure 7:
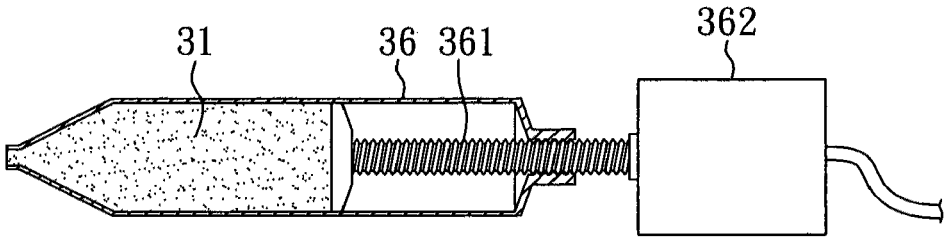
FIG. 7 is a side view of a cosmetics provider which is a pressure nozzle according to a first preferred embodiment of the invention.

FIGS. 4-7 shows side views of examples of different sprinklers, nozzles, or cosmetic tools, such as a piezoelectric nozzle 32, and a brush 34 with a tip 342, a jet nozzle 35, and a pressure nozzle 36 in the rotor 33. FIG. 4 shows a cosmetics container which is the piezoelectric nozzle 32. The piezoelectric nozzle can be driven by a known piezoelectric control technique in a typical printer to output the cosmetic materials in spray or liquid particle. The control device can effectively control the amount of cosmetic materials and the colors to be output. FIG. 5 shows a cosmetics container which is the brush 34. The brush 34 includes a color ink tube 341, and the tip 342 and the color ink tube 341 are bonded by a porous material, as known in a typical highlighter technique. Thus, the color inks outflow without pressing any discharge head when the tip 342 of the brush 34 is lightly slid. FIG. 6 is a side view of a cosmetics container which is the jet nozzle 35. The jet nozzle 35 has a funnel 352 containing the cosmetic materials and an air-pressure tube 351 connected to an air compressor for providing an air flow to an inkjet exit 353 to thereby extract the cosmetic material from the funnel 352 and jet out of the exit 353. The cosmetic material can be a powder or particle, such as a glitter. FIG. 7 shows a cosmetics container which is the pressure nozzle 36. The pressure nozzle 36 has a driving device 362 to drive a rod 361. The driving device 362 is a servo motor, for example. The driving device 362 drives the rod 361 in rotation to thereby pressurize the internal liquid, gel, or nebulized cosmetic material 31 to jet out. Essentially, the operation of the cosmetics containers in an array form of sprinklers, nozzles, or cosmetic tools is automatically controlled by the control device 4.

The base 1 is installed with the control device 4 electrically connected to the robot 2 and the cosmetics provider 3. The control device 4 includes an input interface 41, a control interface 42 with control programs, a distance-measuring device 43, a storage device 44, a makeup-application simulation unit, and a makeup-application operation and control unit. The input interface 41 is an input port to receive an externally input specific facial image F or makeup-application profile C through the storage device 44 (such as a flash drive). The control interface 42 includes a display 421 and a human-machine interface. The display 421 can be a touch panel or typical non-touch display on which the human-machine interface is shown. The display 421 and the human-machine interface are used to input a program or command to the control device 4 for controlling the robot 2 and the cosmetics provider 3 to automatically apply facial make-up. In this embodiment, the specific facial image F and the makeup-application profile C can be a pre-made autodyne picture of a user that is input by the externally connected flash drive, or pre-stored in an image database 45 built in the control device 4. The specific facial image F and the makeup-application profile C can be a 2D or 3D image to be accessed anytime through the storage device 44. The makeup-application simulation unit of the control device 4 has a makeup-application simulation software to edit the specific facial image F into the makeup-application profile C. The makeup-application operation and control unit of the control device 4 can transform the makeup-application profile C into a moving path of the robot 2 and a make-up control signal for the cosmetics provider 3, such that the control device 4 can control the robot 2 to move the cosmetics provider 3 to the make-up application position T corresponding to the facial contour F1 to apply make-up. In this case, the make-up is applied on one upper eyelid, and the cosmetics provider 3 is driven to jet out the cosmetic material 31 (such as an eye shadow material) through the piezoelectric nozzle 32 based on the makeup-application profile C. The distance-measuring device 43 is a laser ranger. The laser ranger sends a distance-measuring light to the upper eyelid of the user and automatically receives the reflective light from the upper eyelid to correctly move the robot to the upper eyelid. When the input specific facial image F and make-up application profile C are a 2D image, the distance-measuring device 43 can provide an X-direction position signal and a position alignment signal in planar measurement in order to provide a position and alignment data of the other in space, thereby changing the 2D image into a 3D image. When the input is a 3D image, an X-axis position alignment signal can be also provided. Specially, when the upper eyelid make-up is applied, the specific facial image F and the make-up application profile C are provided at closed and open eye states.

The aforementioned devices are disposed in a box to function as a make-up kit 5, such that a portable facial make-up application machine is obtained.

In this embodiment, a security sensor 6 is provided. For example, the jaw support 111 and head-positioning element 112 of the face-positioning module 11 can have a security sensor 6 to detect whether the face is within safe range of the make-up application position, which is a pressure sensor electrically connected to the control device 4. When the face of the user is out of the jaw support 111 or does not touch the head-positioning element 112, the security sensor 6 can detect an abnormality due to the pressure change, so as to output an abnormal signal A to the control device 4 to thereby control the cosmetics provider not to provide the material. Thus, the security sensor 6 can exclude the jetting cosmetic material from touching the eyes or unwanted parts of the face that are not appropriately positioned on the face-positioning module 11. The security sensor 6 can be alternately an optical isolator. When the light is blocked, the position of no received signal is obtained to make sure that the user does not position the face inappropriately on the make-up application position T. The security sensor 6 can be alternately a limit switch to detect whether the eyelids are open. The security sensor 6 sends an abnormal signal A through the control device 4 to interrupt the operation of the cosmetic provider 3 when the eye under an eye shadow operation is open. The security sensor 6 can be alternately a button to allow the user to press the button and send the abnormal signal A to thereby interrupt the operation of the cosmetics provider. The security sensor 6 can combine with the distance-measuring device 43 in order to output the abnormal signal A to the control device 4 when the distance-measuring device 43 detects an abnormal distance, thereby interrupting the operation of the control device 4.

Figure 8:
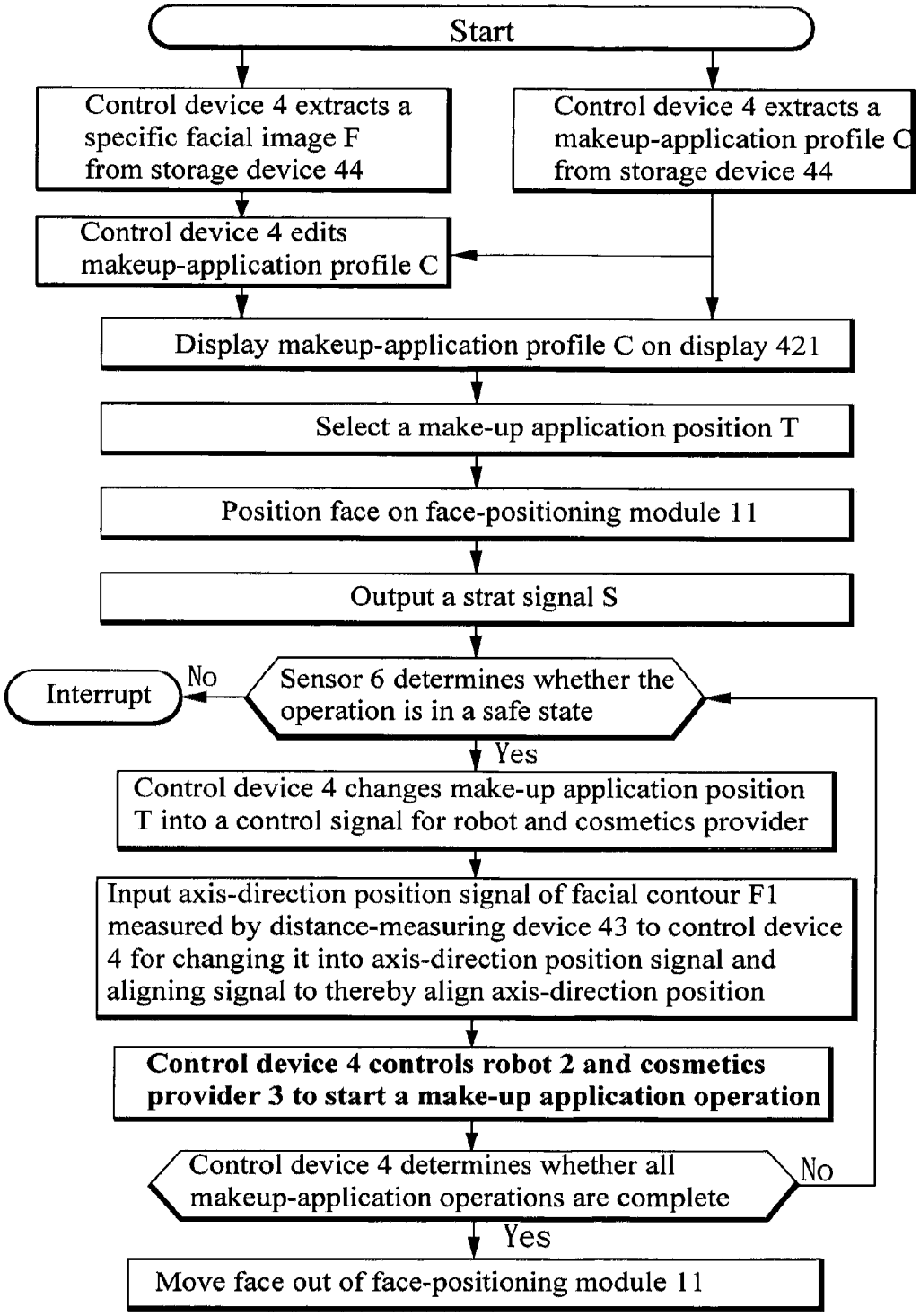
FIG. 8 is flowchart of a makeup example of a facial make-up application machine according to a first preferred embodiment of the invention.

In this embodiment, when the user uses the machine to apply an eye shadow make-up, we are referring to the flowchart of FIG. 8. First, the facial make-up application machine mentioned above is provided and powered on. A user can input a specific facial image F or a makeup-application profile C through the input interface 41 from the storage device 44 to the control device 4, or directly extract a specific facial image F or a facial contour F1 from the storage device 44 of the control device 4 in order to edit the specific facial image F or the facial contour F1 as a desired makeup-application profile C. The edit can be done by the makeup-application simulation software of the makeup-application simulation unit of the control device 4. In this case, the preset eye shadow make-up and associated materials, colors, and proportions are selected to modify the makeup-application profile C. For example, the parameters of color, lighting, saturation, and contrast are added to automatically adjust and meet with the color requirement of the user. Next, the display 421 displays the makeup-application profile C after the simulation, such that the user can preview the eye shadow color or the texture of the applied cosmetics to decide if it is appropriate or meets with the requirement.

Next, the user selects a make-up application position T and disposes the face on the face-positioning module 11. The jaw is on the facial support 111. The forehead abuts against the support section 113 of the head-positioning element 112, and the fixators 114 automatically hold two sides of the head to position the face. When the users see their own face to be positioned at the positioning mark 121 from the mirror 12, it indicates that the face is accurately disposed at the make-up application position T. In this case, the user presses a start button 422 to send a start signal S to the control 4, and the security sensor 6 detects whether the operation is in a safe operation state. If the security sensor 6 sends an abnormal signal A, it indicates "no", i.e., the operation is in an unsafe operation state, and thus the operation is interrupted. Next, the control device 4 changes the make-up application position T of the makeup-application profile C into a control signal of the robot 2 and cosmetics provider 3 to control an application path of the robot 2 and an automatic makeup-application operation of the cosmetic provider 3. Next, a directional position signal measured by the distance-measuring device 43 is input to the control device 4 for obtaining an alignment signal to align the axis-direction position which, in this case, indicates the X axis of FIG. 1. Next, the control device 4 controls the robot 2 and the cosmetic provider 3 to perform the makeup application processing, i.e., detecting whether all make-up operations are complete. Further, it is determined whether an operation is in a safe state when one or more operations are not complete. The user moves the face out of the face-positioning module 11 when all make-up application operations are complete.

The specific facial image F indicates image data after the user takes a picture, and the facial contour F1 indicates user's contour. The makeup-application profile C indicates an edited makeup image, and the make-up application position T indicates a facial zone to be applied with makeup, as shown in FIGS. 9-10.

Such a way allows the user to use the facial make-up application machine to automatically complete a makeup application according to the preset specific facial image F and makeup-application profile C (such as, using an image editing software to pre-edit a shot picture based on the conditions). This can save time and reduce efforts since no personal make-up skill is required and the operation of the machine is quite easy.

Figure 11:
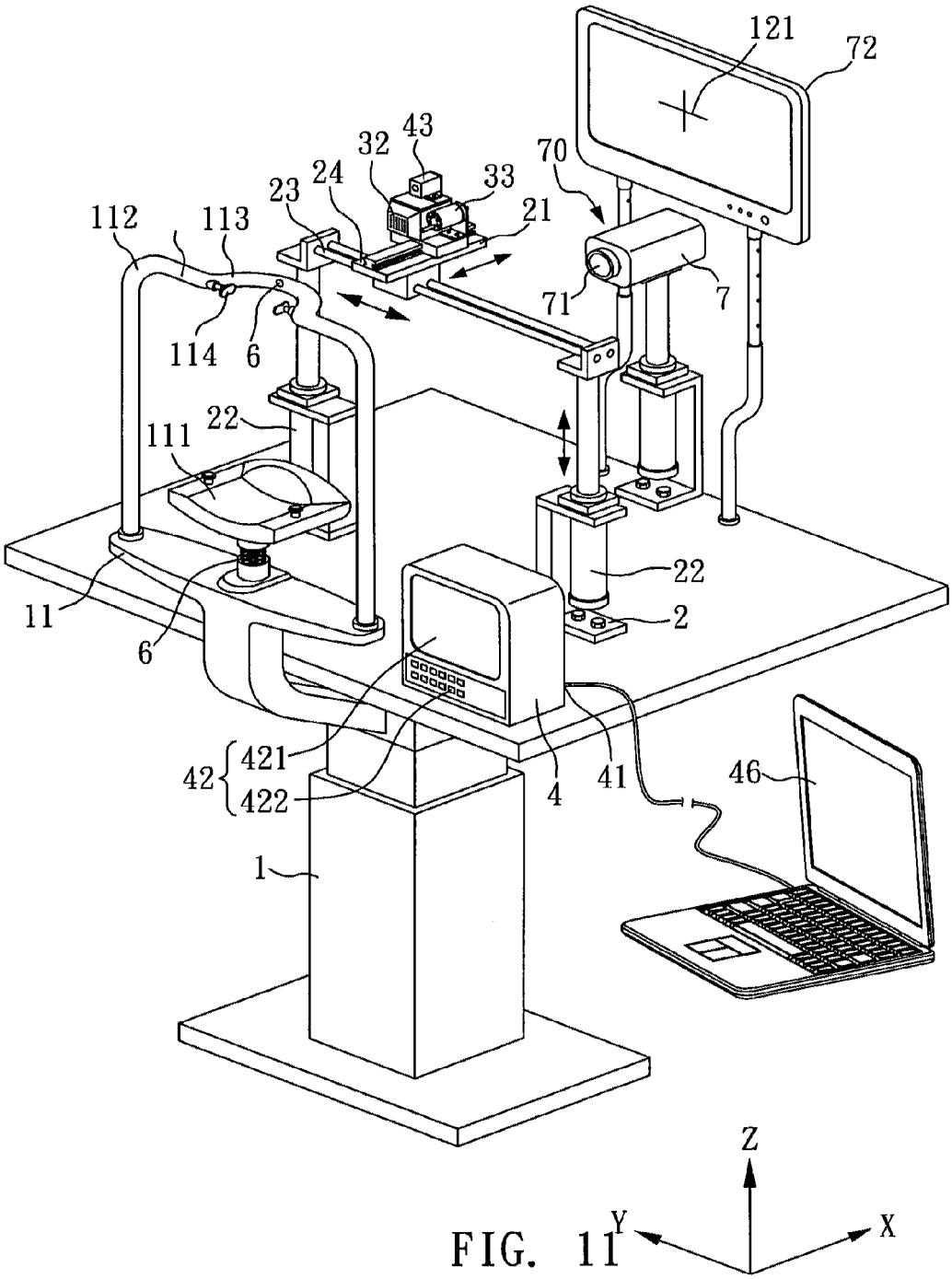
FIG. 11 is a perspective view of a facial make-up application machine according to a second preferred embodiment of the invention.
Figure 12:
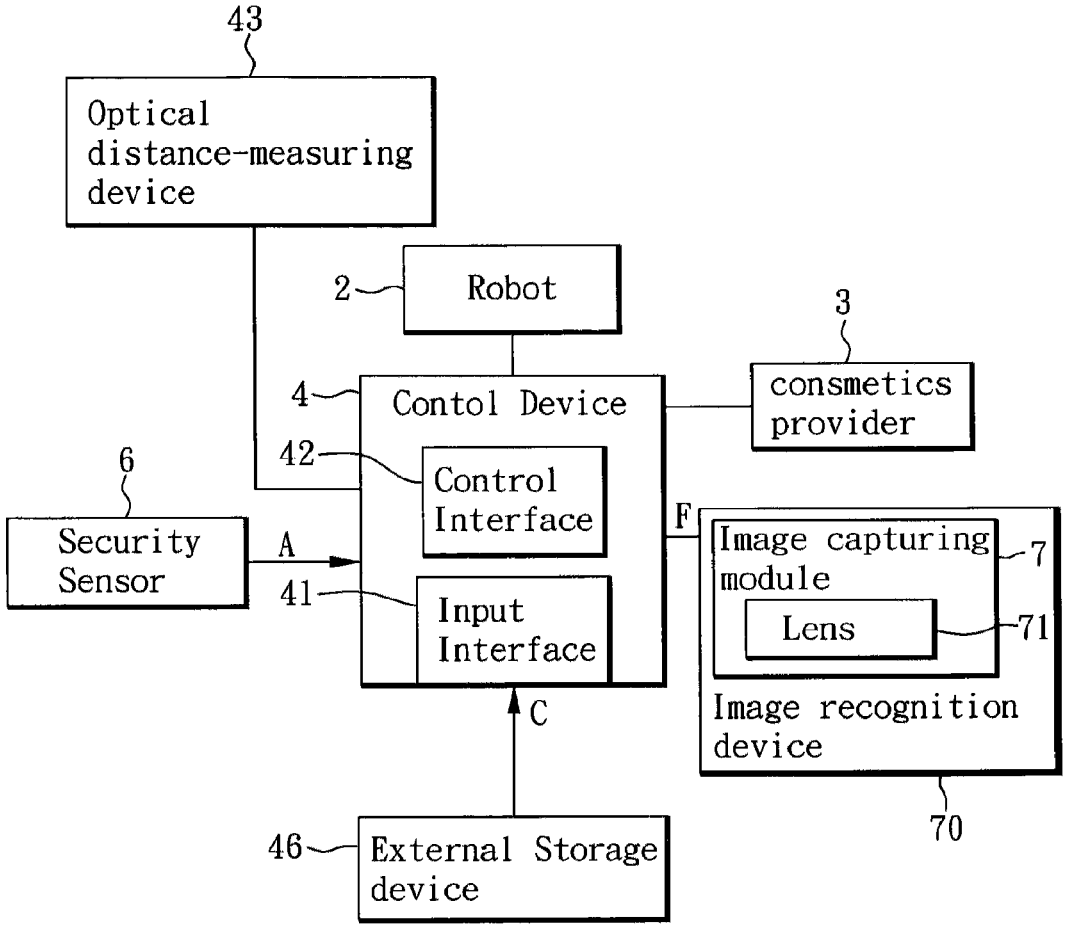
FIG. 12 is a block diagram of a facial make-up application machine according to a second preferred embodiment of the invention.

FIG. 11 is a perspective view of a facial make-up application machine according to a second preferred embodiment of the invention. FIG. 12 is a block diagram of FIG. 12. As shown in FIGS. 11 and 12, the machine includes a base 1, a robot 2, a cosmetic provider 3, a control device 4, a security sensor 6, an external electric device 46 electrically connected with the input internal 41 of the control device 4 and an image recognition device 70. The image recognition device 70 includes an image capturing module 7 electrically connected to the control device 4. The control device 4 has a 2D or 3D position recognition software to recognize the facial contour F1 in a shot image. The differences between the first and second embodiments are described as follows.

As shown in FIGS. 11 and 12, the second embodiment has the image capturing module 7 electrically connected to the control device 4 on the base 1. The image capturing module 7 includes a lens 71 and a screen 72. The lens 71 can shoot 2D or 3D color images to be recognized and converted as an image contour, so as to provide a specific facial image F without preparing in advance. The screen 72 of the module 7 and the display of the control device 4 can concurrently display the specific facial image F of a user, and the positioning mark 121 can be displayed on the screen 72 without disposing a mirror. After the user positions the face on the face-positioning module 11, the user can adjust the face to the positioning mark 121 through the screen 72 in front of the face. Thus, the self-adjustment of facial position is obtained. In addition, during a make-up application operation, the image capturing module 7 can capture the facial contour F1 and convert it into a position signal and alignment signal, such that the lens 71 can feed a signal back to the control device 4 in order to align the make-up application position T and provide the facial contour F1 accurately.

When the specific facial images and the makeup-application profiles are a 2D image, the image capturing module 7 can provide a directional position signal and position alignment signal in 3D measurement in order to provide a position and alignment data of another dimension in space, thereby changing the 2D image into a 3D image. In addition, the image capturing module 7 can function as the security sensor 6. For example, in real-time shooting and monitoring, when the eyes of a user are open for a predetermined period of time, the image capturing module 7 can send an abnormal signal A via the control device to interrupt the operation of the cosmetics provider 3 so as to exclude the jetted cosmetic material 31 from touching the eyes or unwanted parts of the face of the user.

Figure 13:
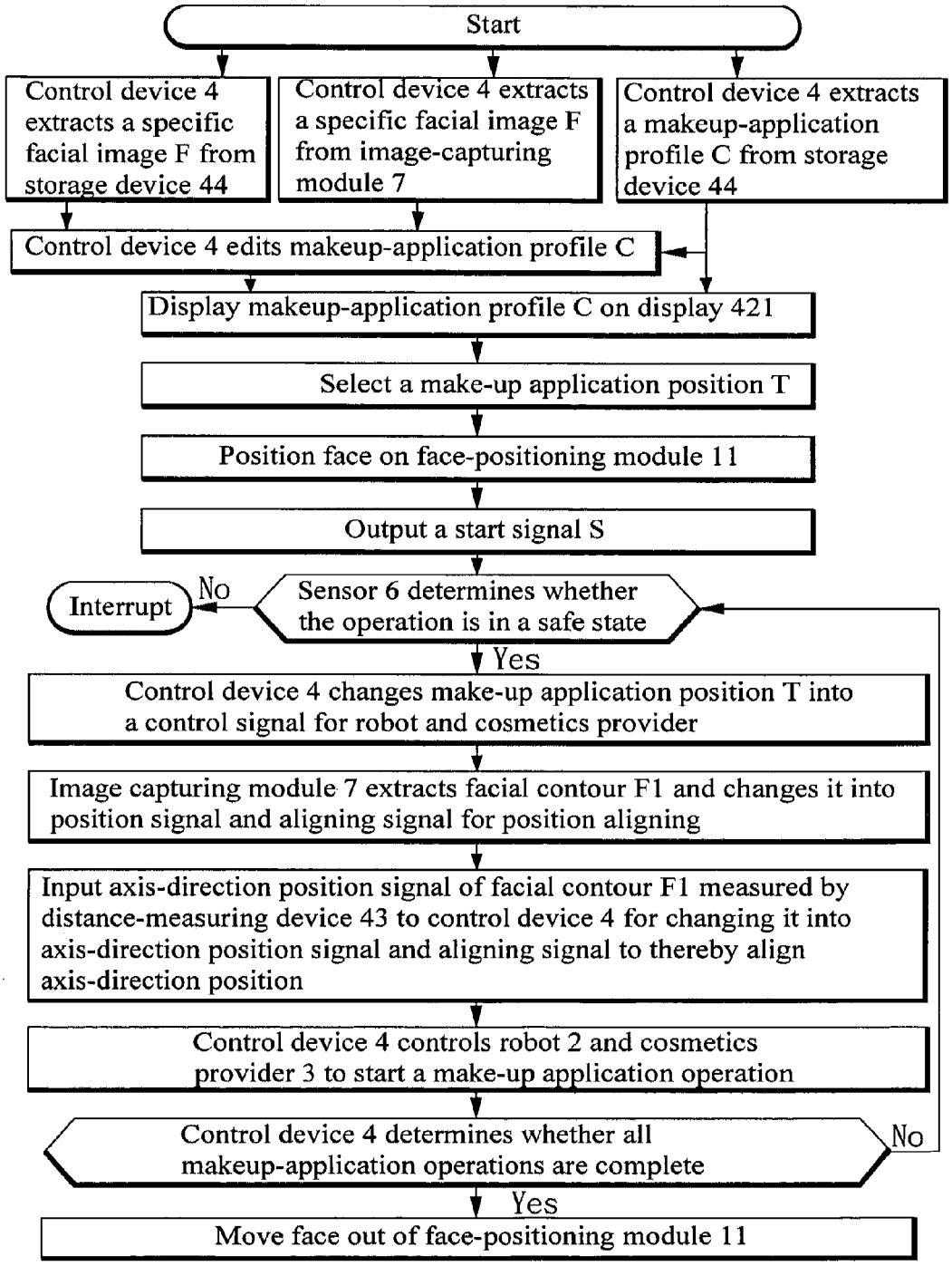
FIG. 13 is flowchart of a makeup example of a facial make-up application machine according to a second preferred embodiment of the invention.

In the second embodiment, the eye shadow application of the makeup application machine is shown in the flowchart of FIG. 13. First, the machine illustrated above is provided and powered on. A user can extract a specific facial image F from the image capturing module 7, and input a specific facial image F or a makeup-application profile C through the input interface 41 from the external storage device 44 to the control device 4, or directly extracts a specific facial image F or a facial contour F1 from the built-in storage device 44 of the control device 4 in order to edit the specific facial image F as a desired makeup-application profile C. The edit can be done by the makeup-application simulation software of the makeup-application simulation unit of the control device 4. In this case, the preset eye shadow make-up and associated materials, colors, and proportions are selected to modify the makeup-application profile C. For example, the parameters of color, lighting, saturation, and contrast are added to automatically adjust and meet with the color requirements of the user. Next, the display 421 displays the makeup-application profile C after the simulation, such that the user can preview the eye shadow color or the texture of the applied cosmetics to decide if it is appropriate or meets with the requirement.

Next, the user selects a make-up application position T and disposes the face on the face-positioning module 11. The jaw is on the facial support 111. The forehead abuts against the support section 113 of the head-positioning element 112, and the fixators 114 automatically hold two sides of the head to position the face. When the user sees their own face to be positioned at the positioning mark 121 in the display 72, it indicates that the face is accurately disposed at the make-up application position T. In this case, the user presses a start button to send a start signal S to the control 4, and the security sensor 6 detects whether the operation is in a safe operation state. If the security sensor 6 sends an abnormal signal A, it indicates "no", i.e., the operation is in an unsafe operation state, so the operation is interrupted. Next, the control device 4 changes the make-up application position T of the makeup-application profile C into a control signal of the robot 2 and cosmetics provider 3 to control an application path of the robot 2 and an automatic makeup-application operation of the cosmetic provider 3. Next, the image capturing module 7 extracts the position signal and alignment signal of the facial contour F1 for alignment of the facial contour F1. Next, an X-axis position signal measured by the distance-measuring device 43 is input to the control device for converting it into an axis-direction position signal and alignment signal to align the axis-direction position which, in this case, indicates the X axis of FIG. 11. Next, the control device 4 controls the robot 2 and the cosmetic provider 3 to perform the makeup application processing, i.e., detecting whether all make-up application operations are complete. Further, it is determined whether an operation is in a safe state when one or more operations are not complete. The user moves the face out of the face-positioning module 11 when all make-up application operations are complete.

Figure 14:
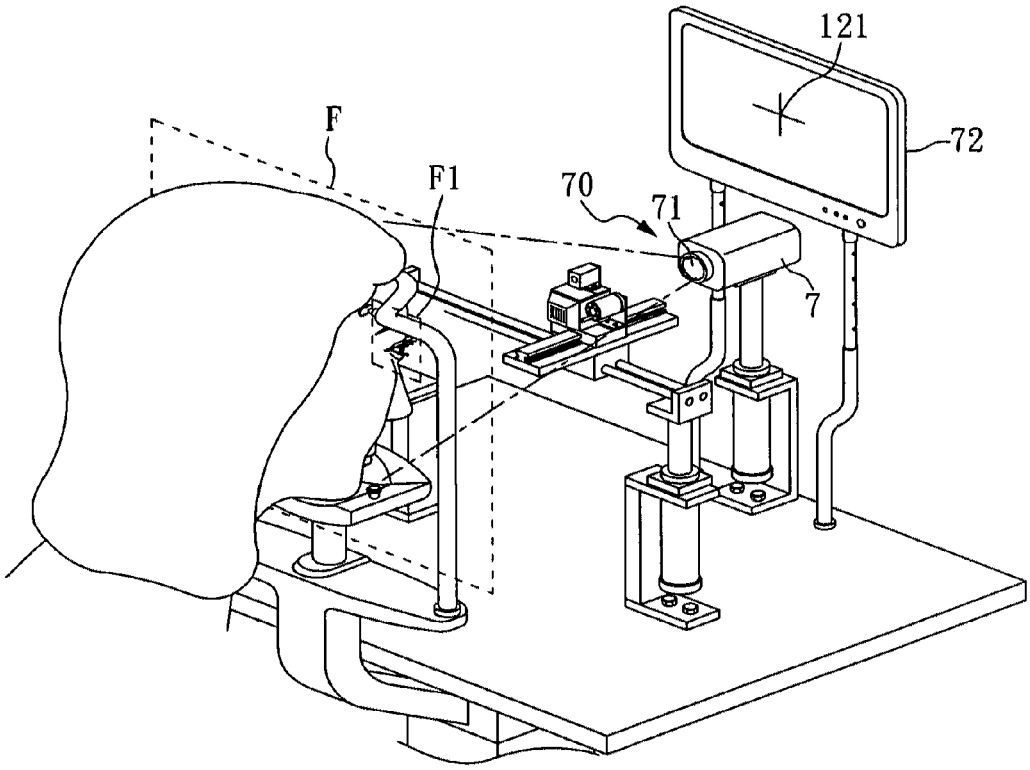
FIG. 14 is a schematic view of a specific facial image F and a facial contour F1 in space according to a second preferred embodiment of the invention.

The specific facial image F indicates image data after the user takes a picture, the facial contour F1 indicates the user contour, the makeup-application profile C indicates an edited makeup image, and the make-up application position T indicates a facial zone to be applied with makeup, as shown in FIGS. 14-15.

A third embodiment is given without the distance-measuring device 43, the image recognition device 70, and the image capturing module 7, and instead a 3D makeup-application profile C is directly extracted and sent to the makeup-application operation and control unit of control device 4 in order to convert the makeup-application profile C into a control signal of the robot 2 and cosmetics provider 3 to control an application path of the robot 2 and an automatic makeup-application operation of the cosmetic provider 3. Thus, the control device 4 can control the robot 2 to move the cosmetics provider 3 to the make-up application position T corresponding to the facial contour F1 for applying makeup. Such a way allows the user to use the facial make-up application machine to automatically complete a makeup application according to the preset makeup-application profile C, without resetting or correcting the parameters, which can save time and reduce efforts since no personal make-up skill is required and the operation of the machine is quite easy.

Figure 18:
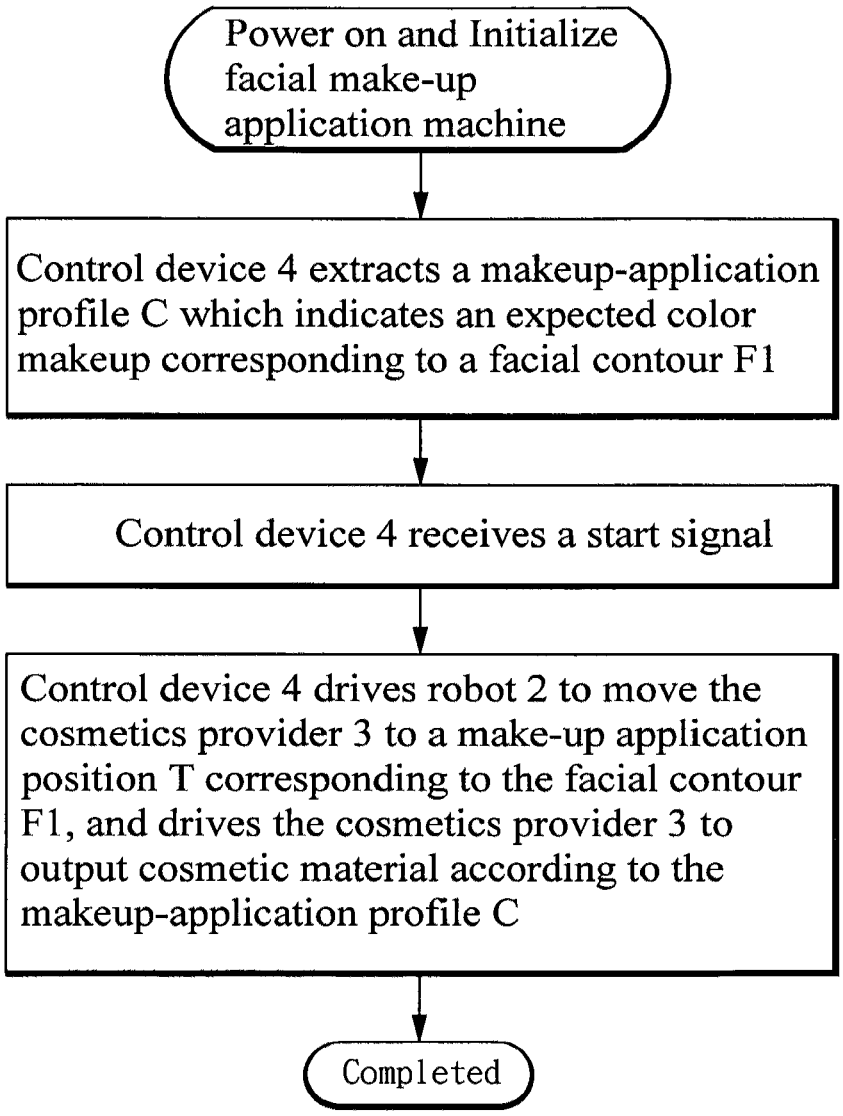
FIG. 18 is a flowchart of a makeup method for a facial make-up application machine according to the invention.

With reference to the first, second, and third embodiments, the invention provides a make-up application method with the facial make-up application machine shown in FIG. 18 includes the steps as follows.

In step A, the machine is powered on.

In step B, the control device 4 extracts a makeup-application profile C which indicates an expected color makeup corresponding to a facial contour F1.

In step C, the control device 4 receives a start signal.

In step D, the control device 4 drives the robot 2 to move the cosmetics provider 3 to the make-up application position T corresponding to the facial contour F1, and drives the cosmetics provider 3 to output the cosmetic materials according to the makeup-application profile C.

When all makeup-application operations for the makeup-application profile C in step D are complete, the control device 4 ends the operation of the robot 2 and controls the robot 2 back to the home position.

The makeup-application profile C in step B can be obtained by extracting and editing a specific facial image F by the control device 4. The specific facial image F includes the facial contour F1.

Accordingly, the user can use only the makeup-application profile C internally preset by the machine to complete a make-up application operation, or input predetermined specific facial image F and use the makeup-application simulation unit of the control device to edit the specific facial image F as the makeup-application profile C. Further, an image capturing module 7 is installed in the machine to capture a specific facial image F of a user himself or herself for a synchronous correction in make-up processing (as shown in the second embodiment), thereby providing a specific facial image F and the facial contour F1 therein to meet with current target scene, and making the color makeup simulation more real.

The start signal in step C can be pressed by the user to output. In addition, step C further includes the security sensor 6 to interrupt the operation after an abnormal signal is received. Also, the security sensor 6 can cooperate with the distance-measuring device 43 or the face-positioning module 11 of the machine to, for example, indicate that the face of the user is accurately positioned on the make-up application position T when the face of the user disposes on the face-positioning module 11 or the head-positioning element 112 of the face-positioning module 11 is a full-size element to completely cover the head. Alternately, the operation is interrupted when the distance-measuring device 43 detects a wrong distance, thereby excluding the control device to drive the cosmetics provider 3 to output the cosmetic material 31 to a user not accurately positioned on the make-up application position T.

The image capturing module 7 in step D further feeds a signal (a feedback signal) back to the control device 4 to align the make-up application position, which uses the distance-measuring device 43 to send the feedback signal to the control device 4 to drive the robot 2 to move to the make-up application position T such that the cosmetics provider 3 on the robot 2 can accurately aim at the make-up application position T, so as to accurately carry out the makeup application according to the face simulated or selected by the user. Further, when the specific facial image F and the makeup-application profile C are 2D images, the distance-measuring device 43 can function as a deep ranger to provide the data of the other dimension in space in order to change the 2D image into the 3D image.

Figure 16:
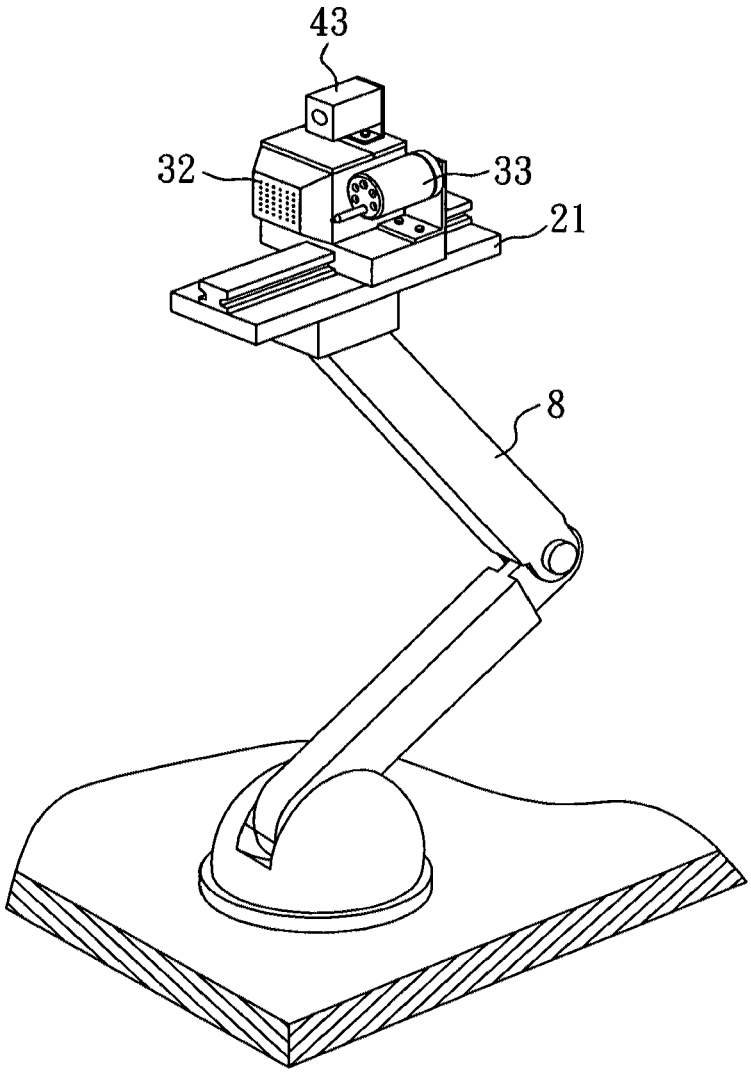
FIG. 16 is a solid view of another robot according to the invention.

FIG. 16 is a perspective view of another robot 8 installed on the base 1. The robot 8 is a typical robot in an auto-machine so as to increase the sensitivity of the robot 8 and thus is helpful to secure accurate makeup-application positioning and the achievement of a high quality make-up application process.

Figure 17:
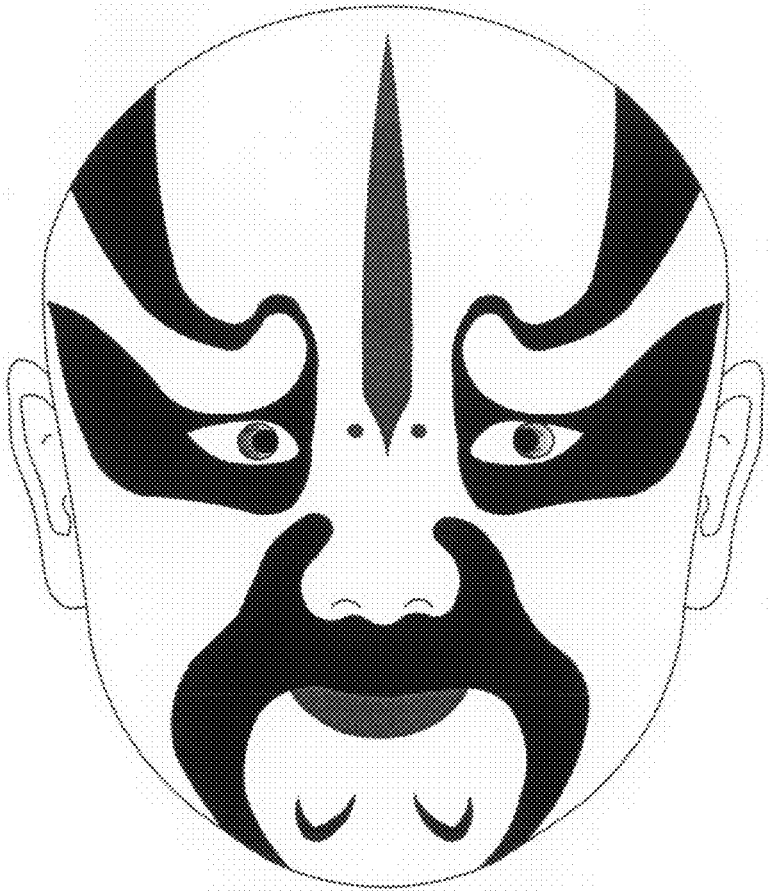
FIG. 17 is a view of a facial mask made by a facial make-up application machine according to the invention.

FIG. 17 is a view of a facial mask made by the facial make-up application machine for a Chinese opera performance. However, the facial mask can be alternately made for a Western opera performance. The invention can also be applied to other kinds of masks or art works which need color makeup.

As cited, the invention can actually improve the inconvenient manual makeup application by automatically applying makeup to the face of a user, reduce the purchase cost on various cosmetics and associated tools, and variously embody a face with makeup which the user selects or emulates in the machine. In addition, the devices of the machine can be miniaturized as a portable machine to be patentable.

Although the present invention has been explained in relation to its preferred embodiment, it is to be understood that many other possible modifications and variations can be made without departing from the spirit and scope of the invention as hereinafter claimed.

What is claimed is:

1. A facial make-up application machine, comprising:

a base installed with a face-positioning module;

a robot installed on the base for a three-dimensional (3D) movement and having a moving block, wherein the robot comprises an elevator, a horizontal rail, and a sliding platform, the moving block is installed on the sliding platform for moving forward and back, the sliding platform is movably installed with the horizontal rail for moving left and right, and the horizontal rail is installed across the elevator for moving up and down;

a cosmetics provider internally storing one or more cosmetic materials and installed on the moving block of the robot, the cosmetics provider having one or more outlets to correspondingly output the one or more cosmetic materials; and a control device installed on the base and electrically connected to the robot and the cosmetic provider, the control device having an input interface and a control interface, the input interface being able to receive a specific facial image with one or more facial contours and a makeup-application profile indicating an expected color makeup corresponding to the facial contour, wherein the control device uses the control interface to drive the robot to move the cosmetics provider to a make-up application position corresponding to the facial contour, and drives the cosmetics provider to output a cosmetic material through an outlet according to a makeup-application profile.

2. The facial make-up application machine as claimed in claim 1, wherein the control device edits the facial contour of the specific facial image as the makeup-application profile.

3. The facial make-up application machine as claimed in claim 1, wherein the specific facial image is provided by an image recognition device electrically connected to the control device and comprising an image capturing module to take a picture, and the image recognition device recognizes the facial contour in the picture.

4. The facial make-up application machine as claimed in claim 3, wherein the image recognition device is configured on the base, and the image capturing module further captures the facial contour and converts the facial contour into a position signal and an alignment signal.

5. The facial make-up application machine as claimed in claim 1, wherein the specific facial image is provided by a storage device electrically connected to the input interface of the control device.

6. The facial make-up application machine as claimed in claim 1, wherein the makeup-application profile is provided by a storage device electrically connected to the input interface of the control device.

7. The facial make-up application machine as claimed in claim 1, wherein the control interface of the control device comprises a display on which a human-machine interface is shown, and the control device drives and controls the robot and the cosmetics provider via the human-machine interface.

8. The facial make-up application machine as claimed in claim 1, wherein the control device further comprises a distance-measuring device to help the control device to drive and control the movement of the robot.

9. The facial make-up application machine as claimed in claim 1, further comprising an external electronic device electrically connected to the control device for controlling the control interface of the control device to drive and control the robot and the cosmetics provider.

10. The facial make-up application machine as claimed in claim 1, further comprising a security sensor electrically connected to the control device, and the security sensor outputs an abnormal signal to the control device when an abnormality is detected.

11. The facial make-up application machine as claimed in claim 1, wherein the face-positioning module of the base comprises a jaw support.

12. The facial make-up application machine as claimed in claim 1, wherein the face-positioning module of the base comprises a head-positioning element.

13. The facial make-up application machine as claimed in claim 1, wherein the outlet of the cosmetics provider is one selected from a group consisting of a piezoelectric nozzle, a brush, a jet nozzle, and a pressure nozzle.

14. The facial make-up application machine as claimed in claim 1, wherein the cosmetics provider comprises a rotor, with the outlets at its perimeter to output the cosmetic materials.

15. The facial make-up application machine as claimed in claim 12, wherein the head-positioning element of the face-positioning module comprises a fixator at two sides to extend and hold the head of the user so as to secure the face in a steady position.

* * * * *